US011298813B1

(12) United States Patent
Lelonek

(10) Patent No.: US 11,298,813 B1
(45) Date of Patent: Apr. 12, 2022

(54) LUG BOLT AND NUT HOLDER DEVICE

(71) Applicant: David J. Lelonek, Orchard Park, NY (US)

(72) Inventor: David J. Lelonek, Orchard Park, NY (US)

( * ) Notice: Subject to any disclaimer, the term of this patent is extended or adjusted under 35 U.S.C. 154(b) by 0 days.

(21) Appl. No.: 17/485,792

(22) Filed: Sep. 27, 2021

(51) Int. Cl.
*B65D 85/28* (2006.01)
*B25H 3/00* (2006.01)

(52) U.S. Cl.
CPC ..... *B25H 3/003* (2013.01)

(58) Field of Classification Search
CPC ..... B25H 3/003; B25H 3/04; B25H 3/06
USPC ..... 206/234, 350, 372–376, 378, 493, 806; 211/69, 69.1, 69.5, 70.6, 70.7
See application file for complete search history.

(56) References Cited

U.S. PATENT DOCUMENTS 3,269,550 A * 8/1966 Marcus ..... B25H 3/04 211/70.6
4,681,219 A * 7/1987 Kitchens ..... A01K 97/06 206/315.11
D310,161 S 8/1990 Blair
4,966,288 A * 10/1990 Kirkham ..... B25H 3/04 211/13.1
5,350,071 A * 9/1994 Pond ..... A47B 43/003 211/117
5,743,394 A * 4/1998 Martin ..... B25H 3/003 206/378
5,743,416 A * 4/1998 Yemini ..... B25H 3/04 211/70.6
6,837,383 B1 * 1/2005 McElhaney, Jr. ..... B25H 5/00 206/373
2003/0024890 A1 * 2/2003 Vollmer ..... A47K 1/09 211/65

OTHER PUBLICATIONS

Wehrs machine & Racing Products, https://wehrsmachine.com/item/5226234-lug-nut-plates, Sep. 27, 2021, 5 pages.
JS Products, https://www.steelmantools.com/lug-bucket-magnetic-parts-holder, Sep. 27, 2021, 4 pages.
Tire Supply Network, https://tiresupplynetwork.com/products/magnetic-lug-nut-holder, Sep. 27, 2021, 4 pages.

* cited by examiner

*Primary Examiner* — Luan K Bui
(74) *Attorney, Agent, or Firm* — Woods Oviatt Gilman LLP; Dennis B. Danella, Esq.

(57) ABSTRACT

A lug bolt and nut holder device is provided. The holder device includes a main body portion having at least one receiving aperture defined therein, wherein the at least one receiving aperture is configured for receiving at least a portion of a lug bolt. The holder device further includes a flange that extends outwardly from the main body portion, wherein the flange includes an upper surface. Further, at least one post extends from the upper surface, wherein the at least one post is configured for being inserted into an opening defined in a nut.

22 Claims, 12 Drawing Sheets

LUG BOLT AND NUT HOLDER DEVICE

FIELD OF THE INVENTION

The present invention relates to a device for holding at least one lug bolt and/or nut, and more particularly, a device that holds a set of lug bolts and/or nuts as a group in a central protected location, wherein the device further includes an attachment feature configured for selectively securing the device to a mounting surface.

BACKGROUND OF THE INVENTION

In the automotive context, different types of fasteners are used to attach different parts of a vehicle to one another. For example, a set of lug nuts are used to secure a wheel to the threaded wheel studs to a vehicle's axle. In other vehicle configurations, lug bolts are used to secure a wheel on a vehicle in which female threaded axles are used. In either case, there are multiple fastening members that are used in the assembly of a vehicle.

When maintenance is being performed on a vehicle that requires the removal of the wheels from the axle, the lug bolts or nuts are removed from the vehicle. When the lug bolts or nuts are removed, there is typically no designated location to place them oftentimes leaving the mechanic to either set them on the floor or on the surface of an arm of the hydraulic lift being used to hold the vehicle during maintenance. Leaving the lug bolts or nuts on the floor or on the hydraulic lift leaves them at risk to fall and scattered across the floor by a mechanic working in the area, or from being chipped or otherwise damaged by other tools or work being performed. The lug bolts or nuts will therefore either be lost or damaged leaving the mechanic to find a suitable replacement part to complete the work which is inefficient from a time and cost perspective.

Thus, what is needed is a device for holding one or more lug bolts and/or nuts in a prescribed location to prevent them from being damaged, as well as maintain these items in a prescribed location near the point of use to improve the efficiency of the work being performed. The present invention addresses these, and other, needs.

SUMMARY OF THE INVENTION

In accordance with an aspect of the present invention, a lug bolt and/or nut holder device is provided. The holder device includes a main body portion having at least one receiving aperture defined therein, wherein the at least one receiving aperture is configured for receiving at least a portion of a lug bolt. The holder device also includes a flange extending outwardly from the main body portion, wherein the flange includes an upper surface. The holder device further includes at least one post extending from the upper surface, wherein the at least one post is configured for being inserted into an opening defined in a nut.

In a further aspect, the holder device includes a mounting system configured for selectively attaching the holder device to a support surface. The mounting system may comprise a fastening device including at least one of a magnet, a screw, a bolt, a hook, or a clamp. The mounting system may optionally include a mounting hole defined in at least one of the main body portion or the flange, wherein at least a portion of the fastening device is positioned in the mounting hole.

In other aspects, the main body portion includes a top surface and a bottom surface, and wherein the at least one receiving aperture extends from the top surface to the bottom surface. The receiving aperture may include a tapered surface extending from the top surface to a point between the top surface and the bottom surface.

In one embodiment, the at least one receiving aperture extends along a first longitudinal axis, and the flange extends in a direction that is perpendicular to the first longitudinal axis. Further, the flange extends from the bottom surface of the main body portion to form a stepped ledge relative to the top surface of the main body portion. Also, the at least one post may extend along a second longitudinal axis, and wherein the first longitudinal axis is parallel with the second longitudinal axis.

Additional objects, advantages and novel features of the present invention will be set forth in part in the description which follows, and will in part become apparent to those in the practice of the invention, when considered with the attached figures.

BRIEF DESCRIPTION OF THE DRAWINGS

These and other details of the invention will be described in connection with the accompanying drawing, which is furnished only by way of illustration and not in limitation of the invention, and in which drawing.

DETAILED DESCRIPTION OF THE INVENTION

Figure 1:
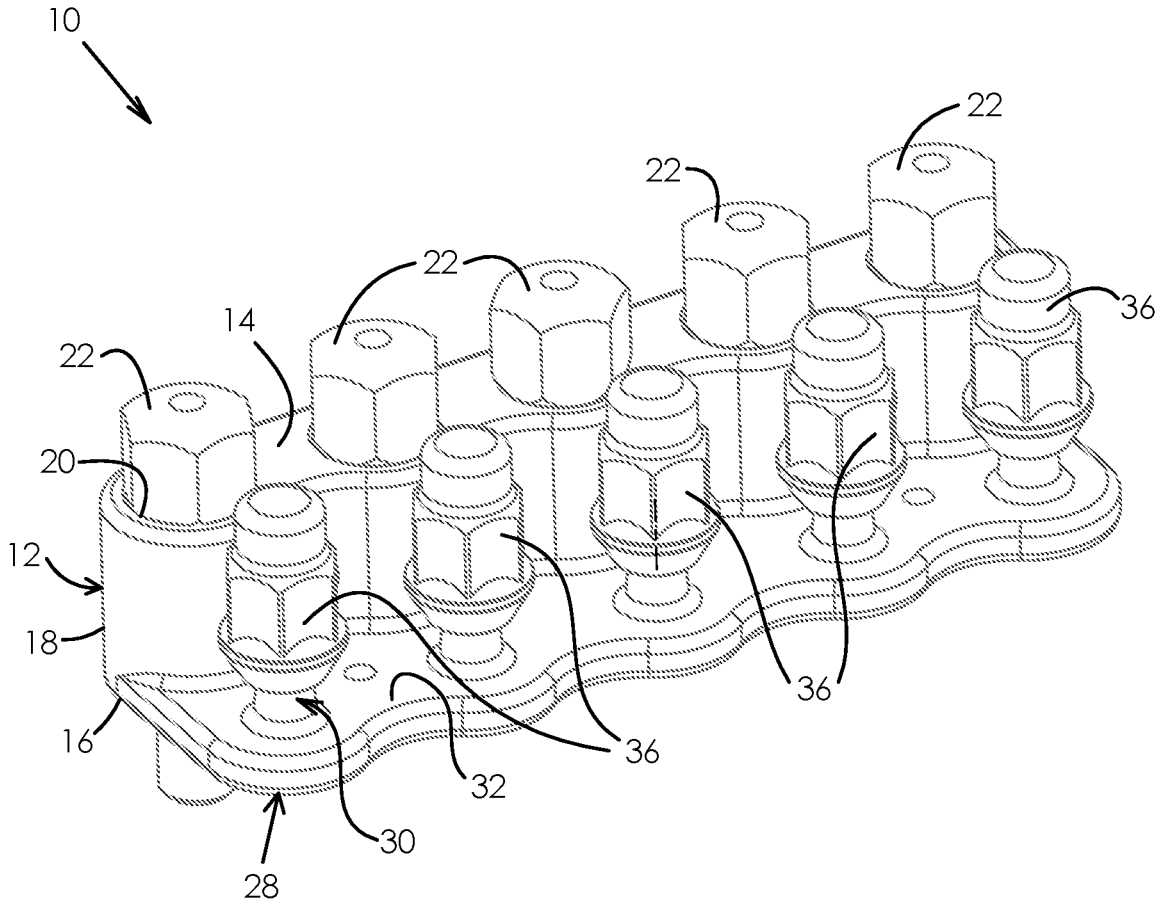
FIG. 1 is a front perspective view of an embodiment of a holder device for one or more lug bolts and nuts in accordance with an aspect of the invention showing a mounting device in a first location.
Figure 2:
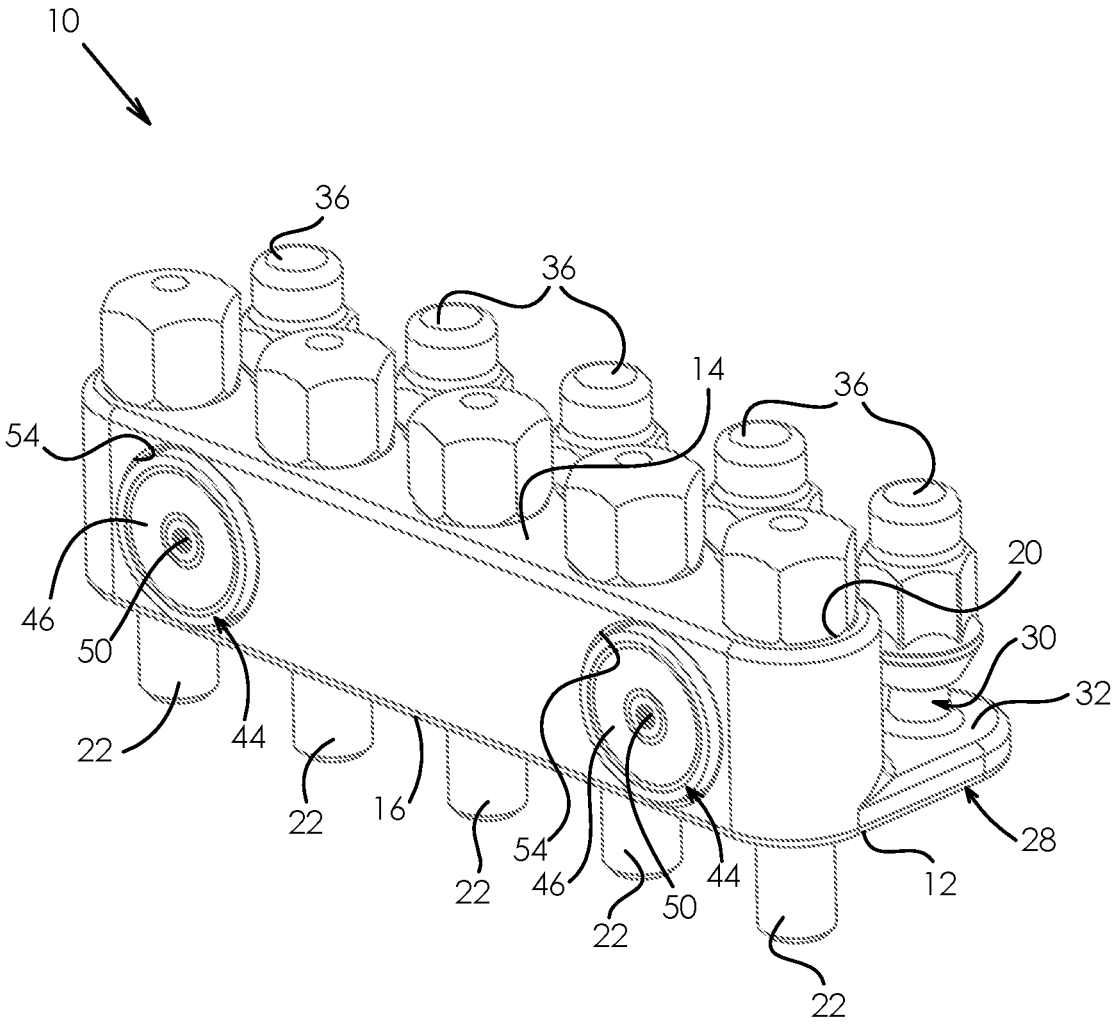
FIG. 2 is a back perspective view of the holder device shown in FIG. 1.

Referring to the drawings in detail, with particular to FIGS. 1-5, reference numeral 10 generally designates an exemplary holder device in accordance with one exemplary embodiment of the present invention. As will be described more fully below, holder device 10 is configured for holding one or more lug bolts and/or nuts in an organized and secure manner and allowing a user to selectively position holder device 10 in a convenient location in a workspace. While the accompanying figures show holder device 10 being used in association with a plurality of lug bolts and nuts having particular configurations, it should be understood that these configurations are merely exemplary and holder device 10 may be adapted to be used with a wide variety of lug bolts and nuts as desired without departing from the spirit of the invention. A description of the various components of an exemplary holder device 10 will now follow.

Holder device 10 comprises a main body portion 12 including a top surface 14, a bottom surface 16 and a side wall 18 generally disposed between top surface 14 and bottom surface 16. Main body portion 12 further includes at least one receiving aperture 20 (FIGS. 3-5) defined therein that is configured for receiving at least a portion of a lug bolt 22. As can be seen in FIG. 4, receiving aperture 20 may be a through-hole that extends from top surface 14 to bottom surface 16 along a longitudinal axis 24 to accommodate lug bolt 22 that has a length that is greater than the distance between top surface 14 and bottom surface 16. In another example, receiving aperture 20 may be a simple hole that extends from top surface 14 and terminates at a location between top and bottom surfaces 14, 16 in cases where the lug bolt has a length that is less than the distance between top and bottom surfaces 14, 16. In the case that receiving aperture 20 is a simple hole or through-hole, with reference to FIGS. 3-5, receiving aperture 20 may optionally include a tapered surface 26 or stepped counterbore (not shown) that extends from the top surface to a location between the top surface and the bottom surface to make it easier to insert the lug bolt into receiving aperture 20 or accommodate a head profile of lug bolt 22.

As best seen in FIGS. 1-5, main body portion 12 includes five receiving apertures 20 defined therein for accommodating a respective number of lug bolts 22. It should be understood that the number of receiving apertures 20 shown in these Figures is merely one exemplary embodiment, and that any number of receiving apertures 20 may be defined in main body portion 12 and fall within the scope of the present invention. In the instance that multiple receiving apertures 20 are included, the longitudinal axis 24 of each receiving aperture 20 may be parallel with one another as seen in FIG. 4.

As best seen in FIGS. 1-3 and 5, holder device 10 includes a flange 28 that extends outwardly from main body portion 12. For example, flange 28 may extend outwardly from side wall 18 of main body portion 12, and more particularly, in a location that is adjacent to bottom wall 16 of main body portion 12 so that an upper surface 32 of flange 28 is essentially stepped down from top surface 14 of main body portion 12. Further, flange 28 may extend from main body portion 12 in a direction that is generally perpendicular from longitudinal axis 24 of receiving aperture 20. However, it should be understood that flange 28 may extend from main body portion 12 in a direction that is non-perpendicular relative to longitudinal axis 24 of receiving aperture 20 and still fall within the scope of the present invention.

Figure 3:
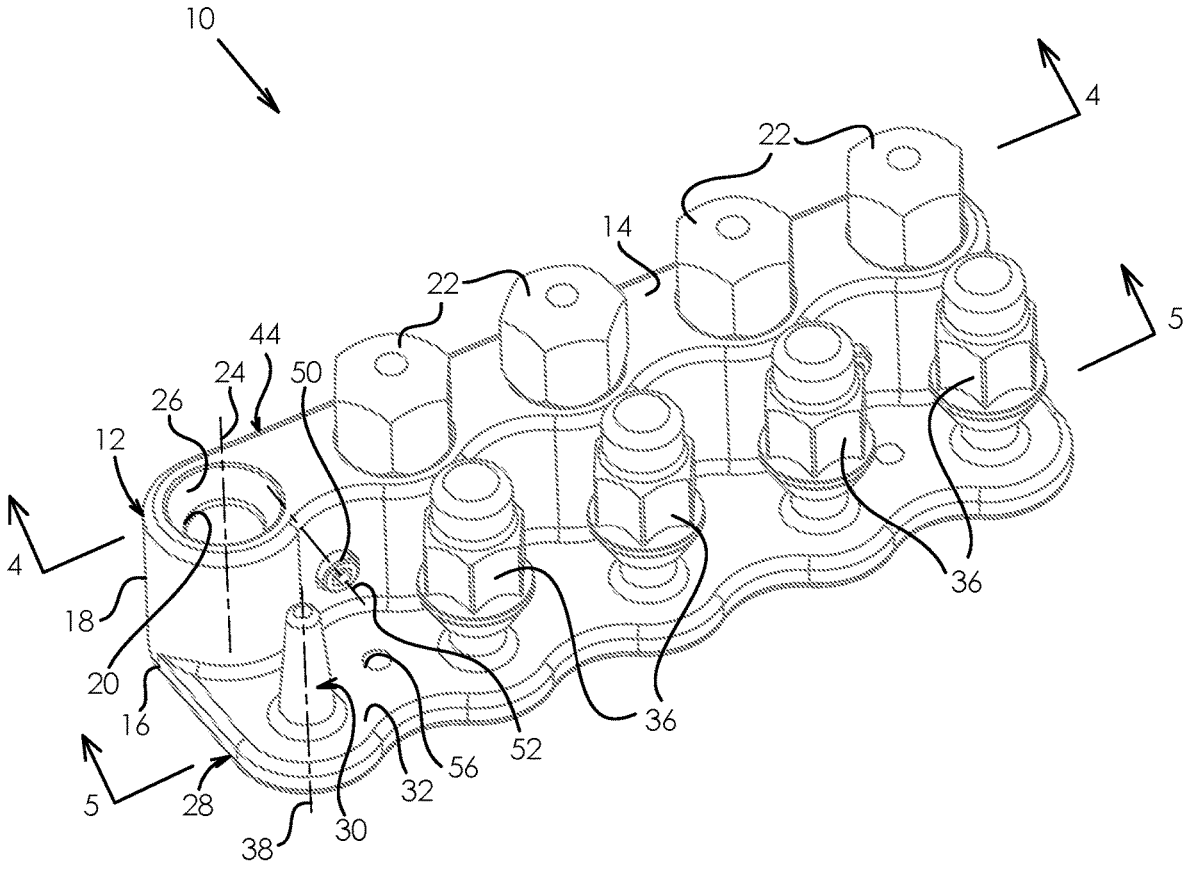
FIG. 3 is a front perspective view of the holder device shown in FIG. 1 with one of the lug bolts and nuts removed.
Figure 3A:
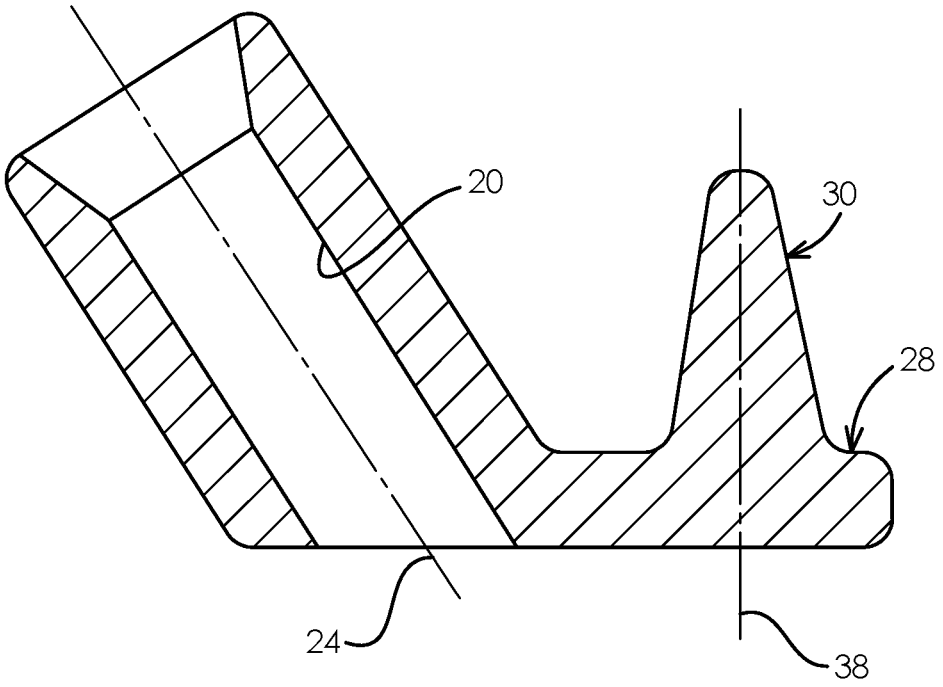
FIG. 3A is a cross-sectional view showing a longitudinal axes of a post of the holder device being non-parallel with a longitudinal axis of a receiving aperture defined in the holder device.
Figure 4:
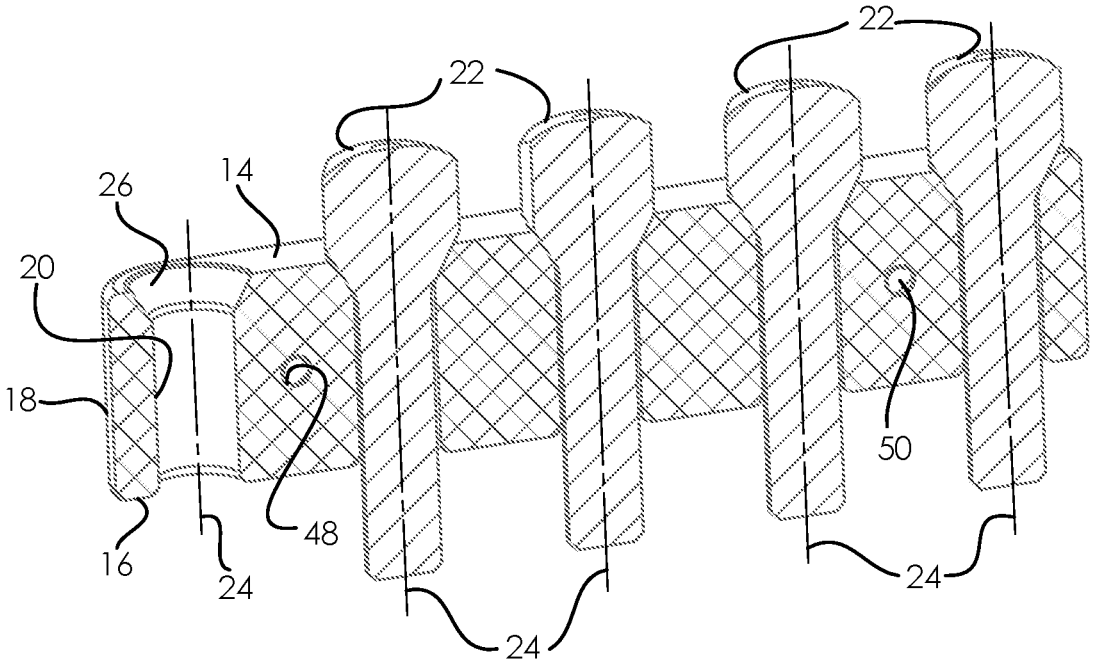
FIG. 4 is a cross-sectional view taken along line 4-4 in FIG. 3.
Figure 5:
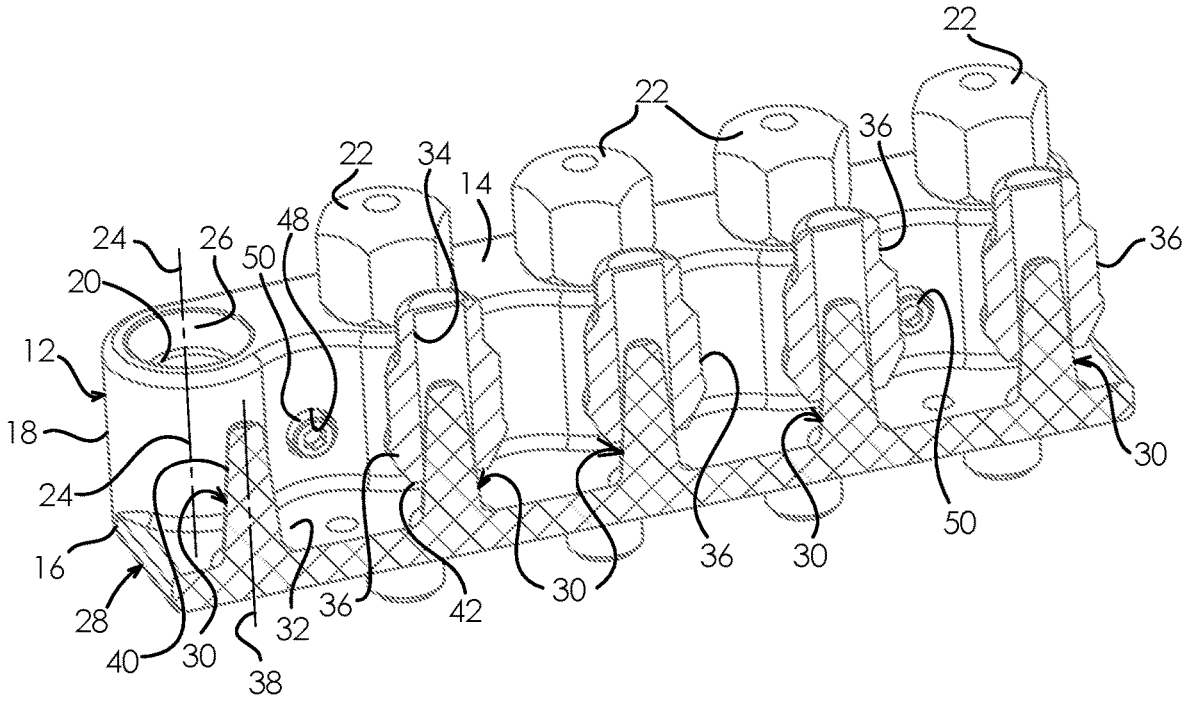
FIG. 5 is a cross-sectional view taken along line 5-5 in FIG. 3 with one lug bolt and one nut removed from the holder device.

As best seen in FIGS. 3 and 5, holder device 10 further includes at least one post 30 that extends from upper surface 32 of flange 28 and which is configured for being inserted into an opening 34 defined in a respective nut 36. Post 30 extends upwardly from flange 28 along a longitudinal axis 38, which may be parallel (or non-parallel—FIG. 3A) with longitudinal axis 24 of receiving aperture 20. The configuration of an outer surface 40 of one or more of posts 30 may conform to opening 34 of respective nut 36, or take any other configuration. For instance, outer surface 40 may be formed in the shape of a frustum (FIG. 5), a cone, a cylinder, or any other shape. In one example, as seen in FIG. 5, the shape of post 30 is such that outer surface 40 engages and secures nut 36 to post 30 using a friction fit. Post 30 may extend a height above upper surface 32 of flange 28 such that a bottom edge 42 of nut 36 contacts upper surface 32, or such that bottom edge 42 does not contact upper surface. 32 as seen in FIG. 5.

With continued reference to FIG. 5, holder device 10 may include five posts 30 for accommodating a respective number of nuts 26. However, it should be understood that the number of posts 30 shown in FIG. 5 is merely one exemplary embodiment, and any number of posts 30 may extend from flange 28 and fall within the scope of the present invention, including but not limited to one post 30. In the instance that multiple posts 30 are included, the longitudinal axis 38 of each post 30 may be parallel with one another. Likewise, it should be understood that any number combination of receiving apertures 20 and posts 30 may be included in holder device 10. It should also be understood that holder device 10 may include just one or more posts 30 with no receiving apertures 20 defined in main body portion 12, or one or more receiving apertures 20 with no posts 30 extending from flange 28. Any of these combinations is contemplated herein and within the scope of the present invention.

As best seen in FIGS. 3-6, holder device 10 may further include a mounting system 44 configured for selectively attaching holder device 10 to a first support surface (not shown), such as, but not limited to, a vertically disposed arm on a vehicle lift or other surface. In one aspect, mounting system 44 may include one or more magnets 46 that are either selectively or fixedly attached to main body portion 12 of holder device 10. Further, main body portion 12 may include a mounting hole 48 defined through side wall 18 that is adapted to receive a fastener 50 that is attached to a respective magnet 46. Mounting hole 48 may extend along a longitudinal axis 52 that is generally perpendicular to longitudinal axis 24 of receiving aperture 20 so that lug bolts 22 and/or nuts 36 are disposed in a generally vertical orientation when inserted in receiving aperture and holder device 10 mounted to a generally vertical support surface. Also, as seen in FIG. 7, main body portion 12 may have a recess 54 defined in the back portion of side wall 18 that is adapted to receive magnet 46. Recess 54 operates to maintain the position of magnet 46 and fastener 50 in main body portion 12 to reduce the chance that these components are inadvertently removed from main body portion 12.

Figure 6:
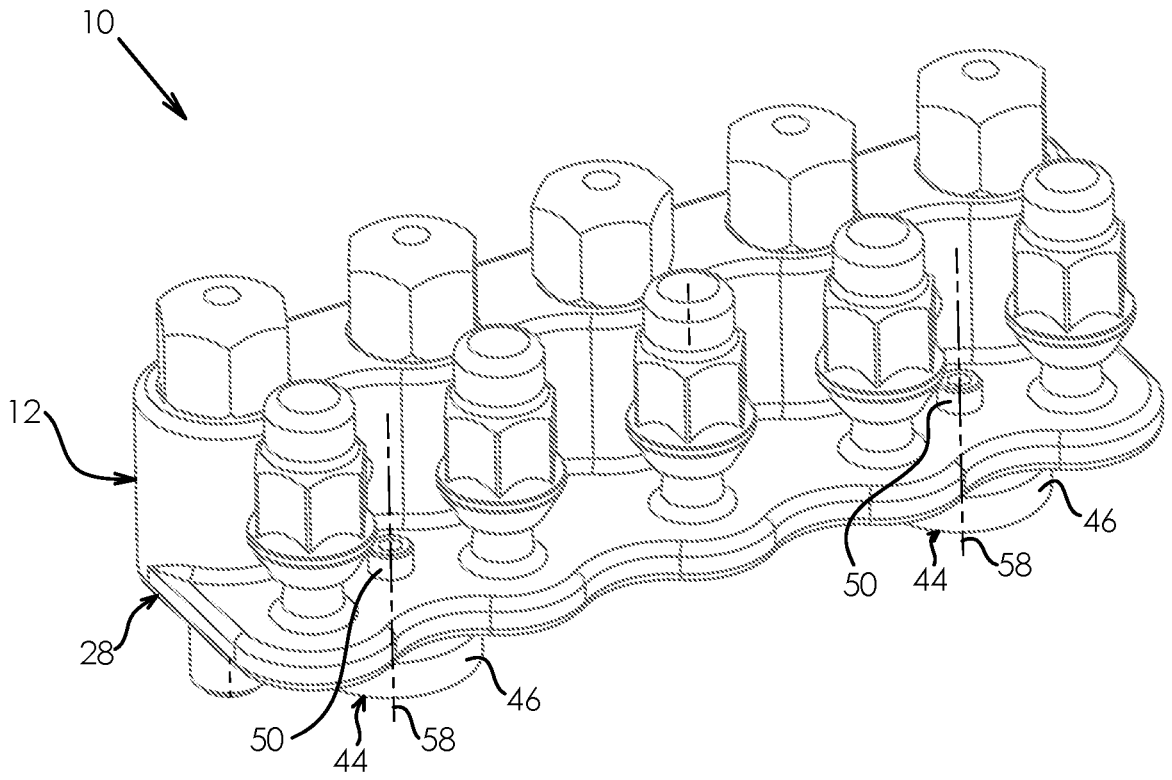
FIG. 6 is a front perspective view of the holder device shown in FIG. 1 with the mounting device in a second location.
Figure 7:
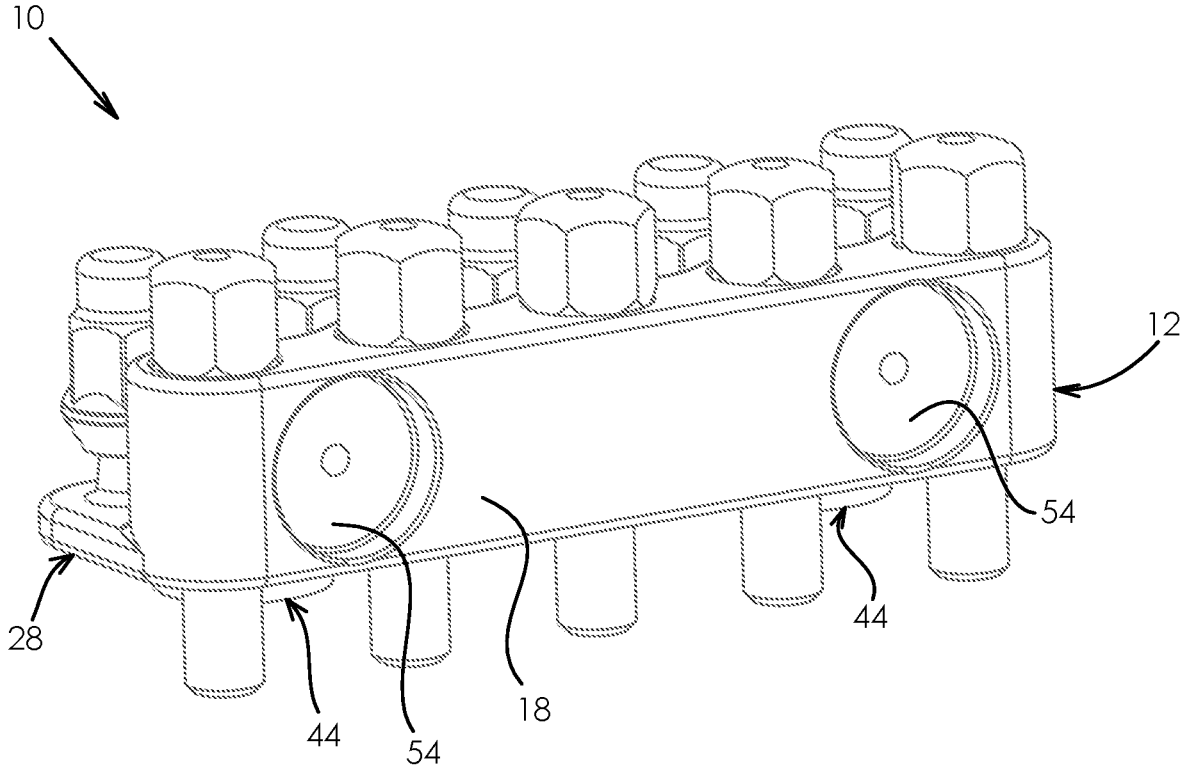
FIG. 7 is a back perspective view of the holder device shown in FIG. 6.
Figure 8:
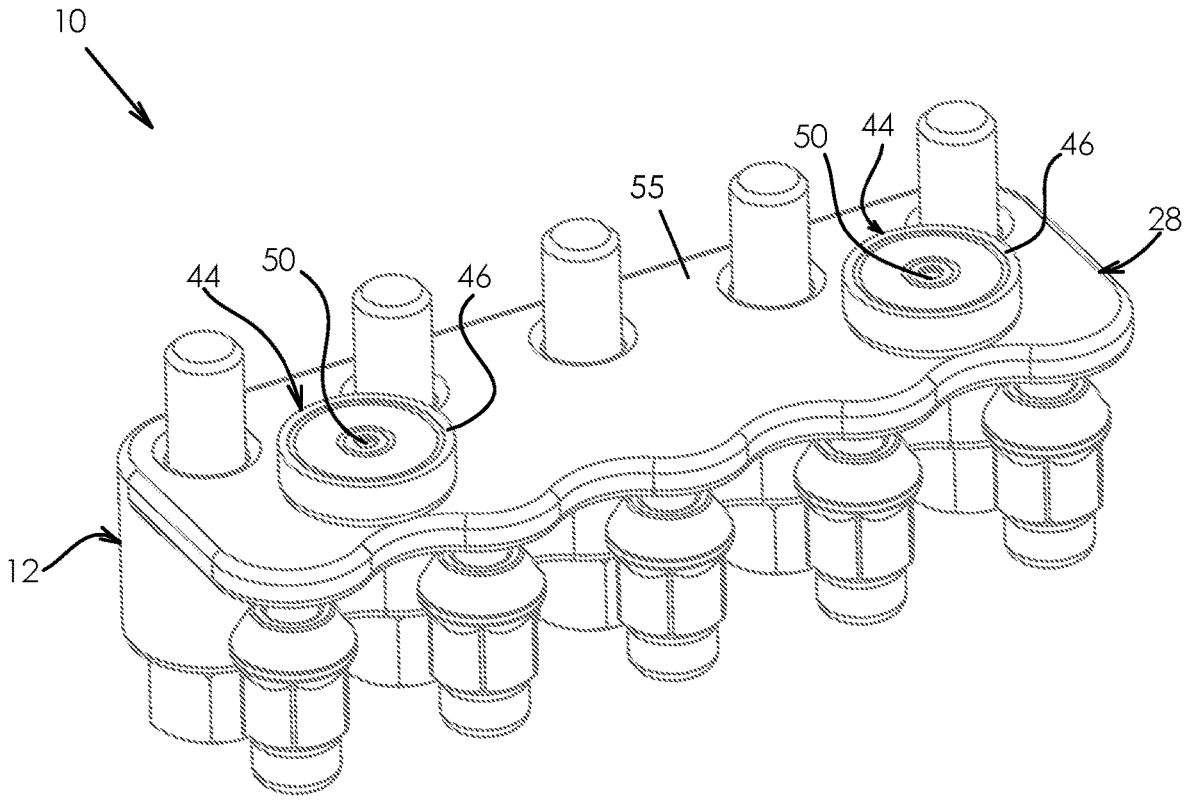
FIG. 8 is bottom perspective view of the holder device shown in FIG. 6.

As best seen in FIGS. 6-8, mounting system 44 may further provide a feature that allows magnet 46 and associated fastener 50 to be selectively or fixedly attached in association with a bottom surface 55 of flange 28 to accommodate for a support surface (not shown), such as, but not limited to, a generally horizontally disposed arm of a vehicle lift or other surface. In particular, flange 28 may include a mounting hole 56 (FIG. 3) defined therein that is adapted to receive fastener 50 that is attached to a respective magnet 46. Mounting hole 56 may extend along a longitudinal axis 58 that is generally perpendicular to longitudinal axis 52 of mounting hole 48 so that lug bolts 22 and/or nuts 36 are disposed in a generally vertical orientation when inserted in receiving aperture and holder device 10 mounted to a generally horizontal support surface. Also, although not shown in the Figures, flange 28 may have a recess defined in the bottom portion of flange 28 that is adapted to receive magnet 46. This recess operates to maintain the position of magnet 46 and shaft 50 in flange 28 to reduce the chance that these components are inadvertently removed from flange 28. As can be seen in FIGS. 1-8, mounting system 44 provides flexibility for mounting holder device 10 to support surfaces that are oriented in either a vertical or horizontal orientation. Moreover, while FIGS. 2-8 show that mounting system 44 includes two sets of magnets 46, fasteners 50 and respective mounting holes 48, 56, it should be understood that mounting system 44 could also use a single magnet, fastener and mounting hole, or more than two sets of magnets, fasteners and mounting holes for purposes of mounting holder device 10 to a support surface.

Figure 9:
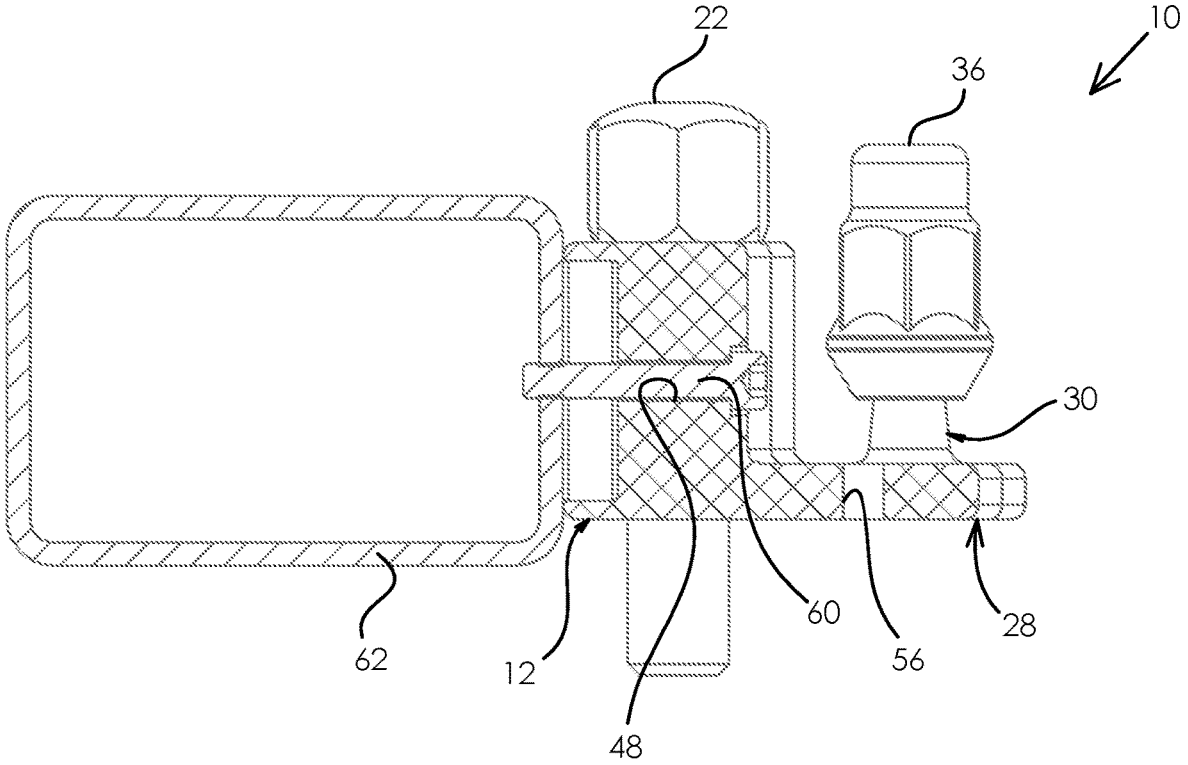
FIG. 9 is a cross-sectional view of the holder device shown in FIG. 1 illustrating an exemplary mounting system.

It is also within the scope of the present invention to incorporate additional or different types of mounting systems in association with holder device 10. For example, as best seen in FIG. 9, instead of using the magnet 46 and fastener 50 combination, it is within the scope of the present invention to insert at least one fastener 60 (e.g., screw or bolt) in a corresponding number of mounting holes 48 and/or mounting holes 56 to directly mount holder device 10 to a support surface 62.

Figure 10:
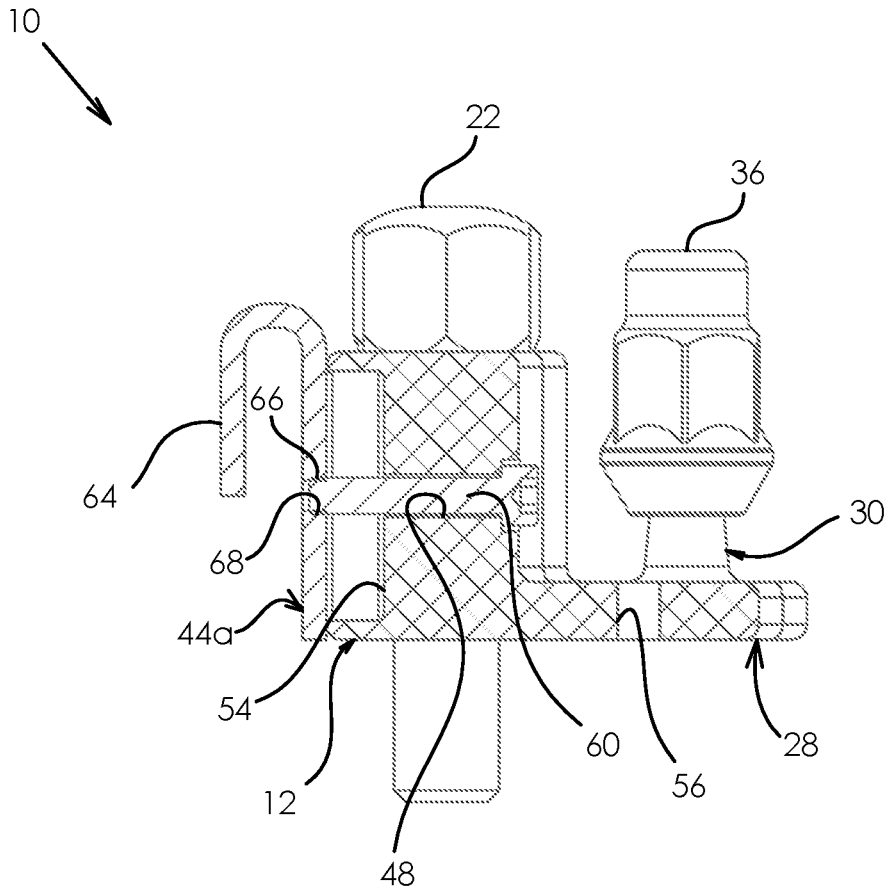
FIG. 10 is a cross-sectional view of the holder device shown in FIG. 1 illustrating another exemplary alternative mounting system.

In another exemplary embodiment, as best seen in FIG. 10, an alternative mounting system 44*a* may include at least one hook 64 coupled to holder device 10 that is configured to selectively attach to a corresponding mounting location. For example, each hook 64 can be coupled to holder device 10 using a fastener 60 (e.g., screw or bolt) positioned in a corresponding mounting hole 48 and/or mounting hole 56, wherein each fastener 60 may be attached to hook 64 using corresponding threads 66, 68 on fastener 62 and the body of hook 60, respectively. It should be understood that hook 64 can be coupled to holder device 10 using other type of methods and mechanisms as well or be integrally formed with main body portion 12. Further, in the exemplary embodiment shown in FIG. 10, the recess 54 that is provided in main body portion 12 for receiving magnet 46 is not necessarily required when using mounting system 44*a*.

Figure 11:
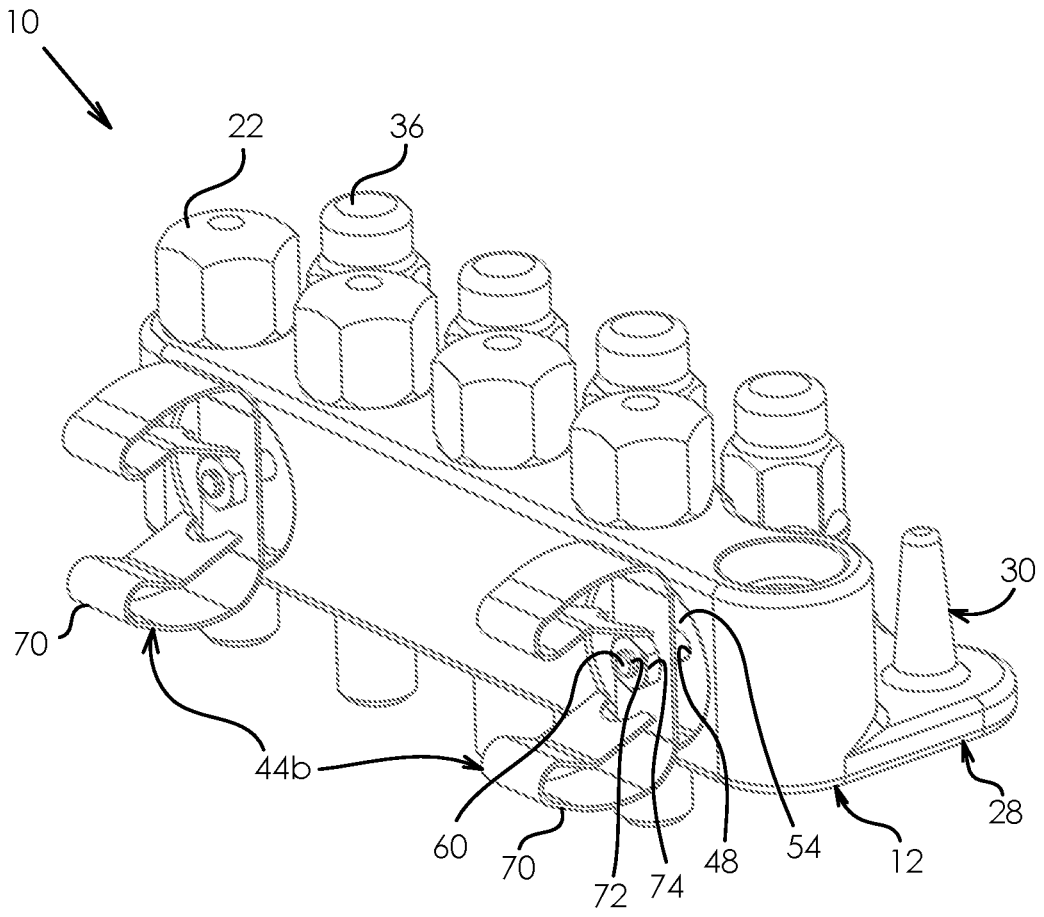
FIG. 11 is a cross-sectional view of the holder device shown in FIG. 1 illustrating yet another exemplary alternative mounting system.

In yet another exemplary embodiment, as best seen in FIG. 11, an alternative mounting system 44*b* may include at least one clamp 70 in association with main body portion 12 and/or flange 28 to mount or snap holder device 10 onto to a support surface. For example, each clamp 70 can be coupled to holder device 10 using fastener 60 positioned in a corresponding mounting hole 48 and/or mounting hole 56, wherein each fastener 60 may be attached to clamp 70 using corresponding threads on fastener and the body of clamp 70. In another example, as seen in FIG. 11, fastener 60 can be disposed in an aperture formed in clamp 70, and a threaded end 72 of fastener 60 can be threadably engaged by a nut 74 to mount clamp 70 to holder device 10. It should be understood that clamp 70 can be coupled to holder device 10 using other type of methods and mechanisms as well. It should be further noted that recess 54 provided in main body portion 12 for receiving magnet 46 is not necessarily required when using mounting system 44*b*.

In use, one or more lug bolts 22 and/or nuts 36 would be stored on holder device 10. In regard to lug bolts 22, the stem of lug bolt 22 would be inserted into a respective receiving aperture 20 in main body portion 12 until the head portion of lug bolt 22 is seated on either top surface 14 of main body portion 12 or against tapered (or stepped) surface 26 of receiving aperture 20. This process would then be repeated until all lug bolts 22 are placed in their respective receiving aperture 20 in main body portion 12. In addition, or alternatively, each nut 36 would be placed on a respective post 30 extending from flange 28. Specifically, post 30 would be disposed in nut opening 34 until either bottom edge 42 of nut 36 is seated against upper surface 32 of flange 28, or a friction fit is achieved between outer surface 40 and nut opening 34 if a frustum or cone shaped post 30 is utilized. Next, the user would identify the orientation of the support surface that holder device 10 will be mounted to, and then selectively mount the fastening device in the appropriate location on holder device. For example, if the orientation of the support surface is generally horizontal and magnets 46/fasteners 50 are being used as the fastening device, then fastener 50 of each magnet 46 is inserted in mounting holes 56, and then holder device 10 is placed on the horizontal support surface so that magnets 46 securely mount holder device 10 thereon. Likewise, if the orientation of the support surface is generally vertical and magnets 46/fasteners 50 are being used as the fastening device, then fastener 50 of each magnet 46 is inserted in mounting holes 48, and then holder device 10 is placed on the vertical support surface so that magnets 46 securely mount holder device 10 thereon. It should be understood that the same methodology would be implemented if a different type of mounting system were used, such as, screws, bolts, hooks or clamps.

As can be seen from the foregoing, the holder device described above eliminates the drawbacks and deficiencies in the prior art. In particular, the holder device includes one or more receiving locations for one or more lug bolts and/or nuts to provide a prescribed location at the point of use for retaining and organizing these items when work in being performed, which reduces the risk of these items from being damaged in the workspace. The mounting system also allows a user to selectively place the holder device on a vertical and/or horizontally positioned support surface in a convenient location. Other advantages may also be realizes through the use of the holder device.

From the foregoing, it will be seen that this invention is one well adapted to attain all the ends and objects hereinabove set forth together with other advantages which are obvious and which are inherent to the device described herein. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement. Further, it should be understood that the use of the terms "module" and "component" herein are interchangeable and shall have the same meaning.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

It is understood that the preceding description is given merely by way of illustration and not in limitation of the invention and that various modifications may be made thereto without departing from the spirit of the invention as claimed.

What is claimed is:

1. A lug bolt and nut holder device comprising:

a main body portion having at least one receiving aperture defined therein, wherein the at least one receiving aperture is configured for receiving at least a portion of a lug bolt, and wherein the main body portion includes a side wall;

a flange extending outwardly from the main body portion, wherein the flange includes an upper surface and a bottom surface;

at least one post extending from the upper surface, wherein the at least one post is configured for being inserted into an opening defined in a nut; and a mounting system configured to be selectively coupled to either the side wall of the main body portion or the bottom surface of the flange to selectively attach the lug bolt and nut holder device to a support surface.

2. A lug bolt and nut holder device in accordance with claim 1, wherein the mounting system comprises a fastening device including at least one of a magnet, a screw, a bolt, a hook, or a clamp.

3. A lug bolt and nut holder device in accordance with claim 1, wherein the mounting system further includes a fastening device, a first mounting hole, and a second mounting hole, wherein the first mounting hole is defined in the main body portion, wherein the second mounting hole is defined in the flange, and wherein at least a portion of the fastening device is positioned in either the first mounting hole or the second mounting hole.

4. A lug bolt and nut holder device in accordance with claim 3, wherein the fastening device is at least one of a magnet, a screw, a bolt, a hook, or a clamp.

5. A lug bolt and nut holder device in accordance with claim 1, wherein the main body portion includes a top surface and a bottom surface, and wherein the at least one receiving aperture extends from the top surface to the bottom surface.

6. A lug bolt and nut holder device in accordance with claim 5, wherein the at least one receiving aperture includes a tapered surface that extends from the top surface to a point between the top surface and the bottom surface.

7. A lug bolt and nut holder device in accordance with claim 1, wherein the main body portion includes a top surface and a bottom surface, and wherein the flange extends from the bottom surface of the main body portion.

8. A lug bolt and nut holder device in accordance with claim 1, wherein the at least one receiving aperture extends along a first longitudinal axis, and wherein the flange extends in a direction that is perpendicular to the first longitudinal axis.

9. A lug bolt and nut holder device in accordance with claim 8, wherein the main body portion includes a top surface and a bottom surface, and wherein the flange extends from the bottom surface of the main body portion.

10. A lug bolt and nut holder device in accordance with claim 8, wherein the at least one post extends along a second longitudinal axis, and wherein the first longitudinal axis is parallel with the second longitudinal axis.

11. A lug bolt and nut holder device in accordance with claim 1, wherein the at least one post is tapered.

12. A lug bolt and nut holder device in accordance with claim 1, wherein the at least one receiving aperture is a plurality of receiving apertures.

13. A lug bolt and nut holder device in accordance with claim 1, wherein the at least one post is a plurality of posts.

14. A system comprising:

a lug bolt;

a lug nut having an aperture defined therein;

a lug bolt and nut holder device comprising:

a main body portion having a plurality of receiving apertures defined therein, wherein each of the plurality receiving apertures are configured for receiving at least a portion the lug bolt, and wherein the main body portion includes a side wall;

a flange extending outwardly from the main body portion, wherein the flange includes an upper surface and a bottom surface;

a plurality of posts extending from the upper surface, wherein each of the plurality of posts are configured for being inserted into the aperture defined in the lug nut; and a mounting system configured to be selectively coupled to either the side wall of the main body portion or the bottom surface of the flange to selectively attach the lug bolt and nut holder device to a support surface.

15. A lug bolt and nut holder device in accordance with claim 14, wherein the mounting system comprises a fastening device, a first mounting hole, and a second mounting hole, wherein the first mounting hole is defined in the main body portion, wherein the second mounting hole is defined in the flange, and wherein at least a portion of the fastening device is positioned in either the first mounting hole or the second mounting hole.

16. A lug bolt and nut holder device in accordance with claim 15, wherein the fastening device is at least one of a magnet, a screw, a bolt, a hook, or a clamp.

17. A lug bolt and nut holder device in accordance with claim 14, wherein the each of the plurality of receiving apertures extend along a respective first longitudinal axis, wherein each of the plurality of posts extend along a respective second longitudinal axis, and wherein the respective first longitudinal axis is parallel with the respective second longitudinal axis.

18. A lug bolt and nut holder device in accordance with claim 14, wherein the each of the plurality of receiving apertures extend along a respective first longitudinal axis, wherein each of the plurality of posts extend along a respective second longitudinal axis, and wherein the respective first longitudinal axis is non-parallel with the respective second longitudinal axis.

19. A lug bolt and nut holder device in accordance with claim 17, wherein the main body portion includes a top surface and a bottom surface, and wherein the flange extends from the bottom surface of the main body portion.

20. A method of selectively mounting a lug bolt and nut holder device to a first support surface provided in a first orientation and a second support surface provided in a second orientation, wherein the lug bolt and nut holder device includes a main body portion having a side wall and a plurality of receiving apertures defined in the main body portion, a flange extending outwardly from the main body portion wherein the flange includes an upper surface and a bottom surface, a plurality of posts extending from the upper surface, and a mounting system, the method comprising:

selectively coupling the mounting system to one of the side wall of the main body portion or the bottom surface of the flange to mount the lug bolt and nut holder device to the first support surface provided in the second orientation;

decoupling the mounting system from the one of the side wall of the main body portion or the bottom surface of the flange; and coupling the mounting system to the other of the side wall of the main body portion or the bottom surface of the flange to mount the lug bolt and nut holder device to the second support surface provided in the second orientation.

21. A method in accordance with claim 20, further comprising the steps of:

placing at least portion of a lug bolt in one of the plurality of receiving apertures;

providing a lug nut having an aperture defined therein; and placing a lug nut so that one of the plurality of posts extend through the aperture.

22. A lug bolt and nut holder device comprising:

a main body portion having at least one receiving aperture defined therein, wherein the at least one receiving aperture is configured for receiving at least a portion of a lug bolt, and wherein the main body portion includes a side wall;

a flange extending outwardly from the main body portion, wherein the flange includes an upper surface;

at least one post extending from the upper surface, wherein the at least one post is configured for being inserted into an opening defined in a nut; and a mounting system configured to be selectively coupled to the side wall of the main body portion to selectively attach the lug bolt and nut holder device to a support surface.

* * * * *